US005829526A

United States Patent [19]

Rogers et al.

[11] Patent Number: 5,829,526

[45] Date of Patent: Nov. 3, 1998

[54] METHOD AND APPARATUS FOR PLACING AND CEMENTING CASING IN HORIZONTAL WELLS

[75] Inventors: Henry E. Rogers; David F. Laurel, both of Duncan; Earl D. Webb, Healdton; Grant L. Hartman, Walters; Kenneth G. Neal, Duncan, all of Okla.

[73] Assignee: Halliburton Energy Services, Inc., Duncan, Okla.

[21] Appl. No.: 745,546

[22] Filed: Nov. 12, 1996

[51] Int. Cl.[6] ..... E21B 33/14

[52] U.S. Cl. ..... 166/291; 166/155; 166/177.4; 166/381

[58] Field of Search ..... 166/289, 291, 166/155, 156, 177.4, 381

[56] References Cited

U.S. PATENT DOCUMENTS

| | | | |
|---|---|---|---|
| 3,358,770 | 12/1967 | Zandmer | 166/289 X |
| 4,986,361 | 1/1991 | Mueller et al. | 166/381 |
| 5,086,843 | 2/1992 | Mims et al. | 166/380 |
| 5,086,844 | 2/1992 | Mims et al. | 166/383 |
| 5,117,915 | 6/1992 | Mueller et al. | 166/381 |
| 5,150,756 | 9/1992 | Hassanzadeh | 166/318 |
| 5,170,847 | 12/1992 | Mims et al. | 166/383 |
| 5,174,375 | 12/1992 | Mims et al. | 166/187 |
| 5,181,571 | 1/1993 | Mueller et al. | 166/381 |

*Primary Examiner*—David J. Bagnell

*Attorney, Agent, or Firm*—Craig W. Roddy; C. Clark Dougherty, Jr.

[57] ABSTRACT

Improved methods and apparatus for placing and cementing a casing string in a horizontal well bore section are provided. A float shoe is attached to the end of the casing string and a float collar is connected in the casing string for trapping air in a first portion of the casing string thereby causing it to be buoyed up during placement by drilling fluid contained in the well bore. A selectively openable and releasable closed baffle assembly is connected within the casing string for trapping air or a low density fluid in a second portion of the casing string thereby causing it to also be buoyed up by drilling fluid in the well bore. The buoying up of the casing string reduces placement drag and consequent compressive loading on the casing string. After placement, the closed baffle means is opened to allow fluid circulation and conditioning of the annulus. A bottom cementing plug is then landed on the baffle assembly and the baffle assembly is released and moved to the float collar. A cement slurry is thereafter placed in the annulus and allowed to set therein.

32 Claims, 5 Drawing Sheets

METHOD AND APPARATUS FOR PLACING AND CEMENTING CASING IN HORIZONTAL WELLS

BACKGROUND OF THE INVENTION

1. Field of the Invention

The present invention relates to improved methods and apparatus for placing and cementing casing in horizontal wells.

2. Description of the Prior Art

In recent years, the drilling and completion of horizontal wells has increased appreciably. A horizontal well is one which includes one or more horizontal well bore sections, i.e., well bores drilled at an angle from vertical of about 60° or greater. The horizontal well bore section or sections usually extend from a vertical or inclined well bore section. The drilling of a horizontal well bore section in a hydrocarbon producing zone allows more of the zone to be in direct contact with the well bore which results in a higher displacement efficiency of the zone as a whole. In some "extended reach wells", the horizontal well bore sections frequently approach 90° from vertical and the horizontal well bore sections are longer than the vertical sections.

In completing a horizontal well, a casing string usually must be run into the horizontal well bore section by sliding it through the well bore. The high drag forces exerted on the casing string can damage the casing joints at their threaded connections. As a result, expensive heavy casing joints with premium thread connections and torque shoulders have been utilized. The casing string can also become stuck as a result of differential pressures which requires the application of additional forces on the casing string to overcome. If sufficient additional forces cannot be applied, the stuck pipe may result in the loss of the well.

Various techniques have heretofore been developed and used for decreasing the forces required to run casing strings in horizontal wells. For example, the well bore drilling fluid has been replaced with a high density fluid prior to running a casing string in a horizontal well bore section to provide buoyant forces on the casing. In addition, a retrievable packer has been included in the casing string for the purpose of trapping a fluid lighter than the well bore fluids between the packer and the end of the casing string. U.S. Pat. No. 4,986,361 dated Jan. 22, 1991, U.S. Pat. No. 5,117,915 dated Jun. 2, 1992 and U.S. Pat. No. 5,181,571 dated Jan. 26, 1993, all issued to Mueller et al., disclose apparatus for trapping air in the leading portion of a casing string to thereby increase the buoyancy of the casing string in drilling fluid contained in the well bore. In one embodiment, the apparatus includes a float shoe and a sliding air trapping insert in the casing string. The air trapping insert is opened to allow fluid circulation and then moved to a position adjacent the float shoe when a cementing plug followed by a cement slurry is pumped into contact with the insert. Thereafter the cement slurry is pumped into the annulus and allowed to set.

While the above and other methods and apparatus have been utilized successfully, there is still a need for improved methods and apparatus for reducing casing string drag and eliminating the need for the use of expensive heavy casing joints to prevent damage as a result of excessive forces exerted on the casing string.

SUMMARY OF THE INVENTION

The present invention provides improved methods and apparatus for placing and cementing casing in horizontal wells which meet the needs described above and overcome the deficiencies of the prior art.

The improved apparatus of this invention basically comprises a float shoe attached to the leading end of the casing string, a float collar connected in the casing string for trapping air in a first portion of the casing string thereby causing it to be buoyed up during placement by drilling fluid whereby drag is reduced, and a selectively openable and releasable closed baffle assembly connected in the casing string for trapping a low density fluid in a second portion of the casing string thereby causing it to also be buoyed up during placement by drilling fluid. The selectively openable and releasable closed baffle assembly includes a fluid pressure operable valve member attached thereto, and the assembly is connected within the casing string by a predetermined fluid pressure releasable connector assembly.

The improved methods of this invention for placing and cementing casing in a horizontal well bore section of a horizontal well containing drilling fluid basically comprise the steps of connecting a float shoe to the lower end of a first joint of casing and running the first joint of casing into the well. Additional joints of casing are connected to the first joint and to each other which are run into the well without being filled with fluid thereby forming a string of casing containing only air. A float collar is connected to the string of casing containing air to trap the air therein, and additional joints of casing are connected to the float collar which are filled with air or other low density fluid as they are run into the well. A selectively openable and releasable closed baffle assembly is next connected within the interior of the string of casing which traps the air or low density fluid within the portion of the string of casing between the float collar and the baffle assembly whereby that portion of the string of casing and the portion of the string of casing between the float shoe and float collar filled with air are buoyed up by drilling fluid in the horizontal well bore section as the string of casing is run therein. Additional joints of casing are connected to the string of casing above the closed baffle assembly and such joints are filled with drilling fluid as they are run into the well. After the string of casing has been placed in the well, the closed baffle assembly is opened whereby the low density fluid and/or air percolates up through the drilling fluid in the casing to the surface. If desired, the low density fluid and/or air can be displaced through the string of casing into the annulus between the string of casing and the well and circulated to the surface. Thereafter, a cement slurry is flowed through the string of casing into the annulus and allowed to set into a hard impermeable mass therein.

It is, therefore, a general object of the present invention to provide improved methods and apparatus for placing and cementing casing in horizontal wells.

Other and further objects, features and advantages will be readily apparent by those skilled in the art upon a reading of the description of preferred embodiments which follows when taken in conjunction with the accompanying drawings.

DESCRIPTION OF PREFERRED EMBODIMENTS

As is well understood, horizontal wells generally include a first vertical or inclined well bore section which is connected to one or more horizontal well bore sections. The horizontal well bore section or sections deviate from vertical by at least about 60° and can and often do deviate as much as 90° or greater. In order to place a string of casing in a well bore including a horizontal well bore section, the string of casing usually must be lowered through the vertical or inclined well bore section and then slid into the horizontal well bore section. Because a great deal of force is often required to slide the casing string into the horizontal well bore section, it has heretofore been necessary to utilize expensive heavy casing joints which include premium thread connections and torque shoulders whereby they resist damage as a result of the high forces exerted on them. The methods and apparatus of the present invention reduce the forces which are required to be exerted on the casing string during placement in a horizontal well, and often eliminate the necessity of using expensive high strength casing joints, and/or allow the use of larger casing sizes in extended reach wells. In addition, the apparatus of this invention requires neither special surface equipment nor the use of any type of work string or line to operate as do some prior art apparatus. Further, the apparatus is fluid pressure operated from the surface and is adaptable to any casing size or type of cementing plug. Also, the selectively openable and movable baffle assemblies of this invention which do not require the drill out of special collars and the like can be used in performing a variety of down hole operations including cementing operations involving selective release cementing plug apparatus and the like.

Figure 1:
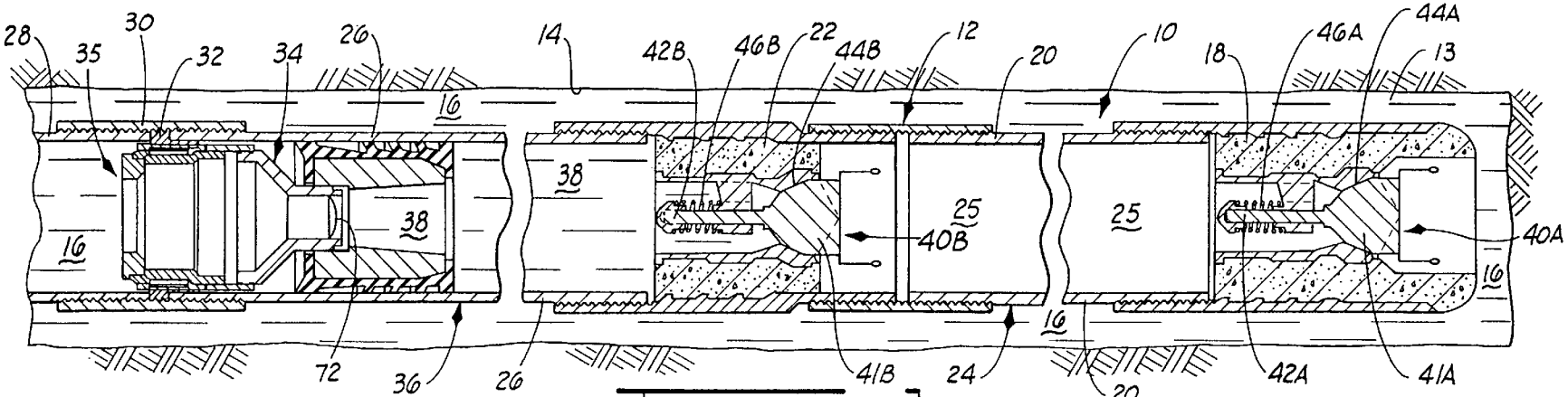
FIG. 1 is a side cross-sectional view of a horizontal well bore section having a casing string including the apparatus of the present invention disposed therein.

Referring now to the drawings, and particularly to FIG. 1, the improved apparatus of the present invention for placing and cementing a string of casing in a horizontal well is illustrated and generally designated by the numeral 10. The apparatus 10 includes a string of casing 12 which has been placed in a horizontal well bore section 14 while being buoyed up by drilling fluid 16 contained in the well bore 14. The buoying up of the casing string 12 by the drilling fluid 16 allows the casing string 12 to be run or placed in the horizontal well bore section 14 without incurring excessive drag and without requiring excessive forces to be placed on the casing string 12. As will be understood by those skilled in the art, the horizontal casing string 12 is comprised of a plurality of casing joints threadedly connected together and the string of casing 12 is connected to additional casing 28 which extends to the surface through an upwardly extending well bore section (not shown). The term "casing" is used herein to mean casing, liners or other pipe which is cemented in a well bore.

The apparatus 10 basically comprises a conventional float shoe 18 connected to a plurality of connected casing joints 20. The other end of the connected casing joints 20 is connected to a conventional float collar 22. The float shoe 18, the connected joints of casing 20 and the float collar 22 make up a first portion 24 of the casing string 12 which is filled with air (designated by the numeral 25) as will be described further hereinbelow. Connected to the opposite end of the float collar 22 from the connected joints of casing 20 is another plurality of connected casing joints 26. The other end of the connected casing joints 26 is connected to connected casing joints 28 forming the vertical or inclined section of the well bore (not shown) by a threaded casing collar 30. A collet retainer 32 is clamped between the ends of the casing joints 26 and 28 connected by the collar 30, and a selectively openable and releasable closed baffle assembly 34 is releasably connected to the collet retainer 32. The connected casing joints 26 between the float collar 22 and the baffle assembly 34 make up a second portion 36 of the casing string 12 which is also filled with air or a low density fluid 38.

The casing string 12, as well as the additional connected casing joints 28 that extend to the surface, are made up on the surface as the casing is being inserted in the well bore. That is, the float shoe 18 is connected to the end of a first joint of casing 20 and the float shoe and first joint of casing are run into the well. Additional joints of casing 20 are connected to the first joint 20, and the first and additional joints 20 are run into the well without filling them with drilling or other fluid thereby forming the first casing string portion 24 containing only air. The float collar 22 is next connected to the casing string portion 24 which traps the air therein followed by the additional casing joints 26 which are connected to the float collar 22 and to each other forming the second casing string portion 36. As the casing joints 26 forming the casing string portion 36 are connected and run into the well bore, they are filled with air or a low density fluid 38. The selectively openable and releasable closed baffle assembly 34 is connected within the interior of the casing string portion 36 which traps the air or low density fluid 38 therein. Thereafter, the additional casing joints 28 are connected to the casing string portion 36 while being filled with drilling fluid. As mentioned, the casing string portions 24 and 36 containing air 25 and air or low density fluid 38, respectively, are buoyed up by the higher density drilling fluid 16 contained in the well bore 14 as the casing string 12 is inserted in the well bore 14.

The structure and operation of the float shoe 18 and float collar 22 are conventional and well understood. As illustrated in the drawings, both the float shoe 18 and float collar 22 include spring biased check valves 40A and 40B, respectively, comprised of valves 41A and 41B connected to valve stems 42A and 42B. The valves 41A and 41B seat on valve seats 44A and 44B and are urged to the closed position by springs 46A and 46B. Both the float shoe 18 and float collar 22 allow pressurized fluid outflow (in directions toward and through the leading end of the casing string 12), but prevent inflow. Thus, the air trapped within the casing string portion 24 is prevented from entering the casing string portion 36 by the check valve 40B of the float collar 22. The air is initially prevented from flowing through the check valve 40A of the float shoe 18 by the bias applied to the valve 41A by the spring 46A. Thereafter, the hydrostatic pressure of the drilling fluid in the well bore is greater than the pressure of the air in the casing string portion 24 which prevents the check valve 40A from opening.

While, as indicated above, the portion 36 of the casing string 12 can be filled with a low density fluid other than air to increase the weight of the casing string or for any other reason, the portion 36 will normally be filled with air. When used, the low density fluid can be any fluid which is compatible with the drilling fluid used and has a desired density. Examples of such low density fluids are water, aqueous emulsions, aqueous foams, hydrocarbon liquids and the like.

The drilling fluid 16 contained in the well bore 12, placed in the connected casing joints 28 and circulated through the casing string 12 and annulus 13 can be any conventional weighted drilling fluid. The term "drilling fluid" is used herein to mean any fluid utilized to drill the well bore 14 or otherwise circulated into the well bore 14 and/or annulus 13. Most commonly, the drilling fluid is an aqueous fluid containing viscosifying agents such as hydratable clays and polymers, weighting materials and other additives. Regardless of the particular type of drilling fluid used, it should have as high a density as is practical without exceeding the fracture gradients of the subterranean zones penetrated by the well bore. Generally, the drilling fluid has a density in the range of from about 9 to 20 pounds per gallon, more preferably from about 10 to about 18 pounds per gallon and most preferably from about 12 to about 15.5 pounds per gallon.

Figure 7:
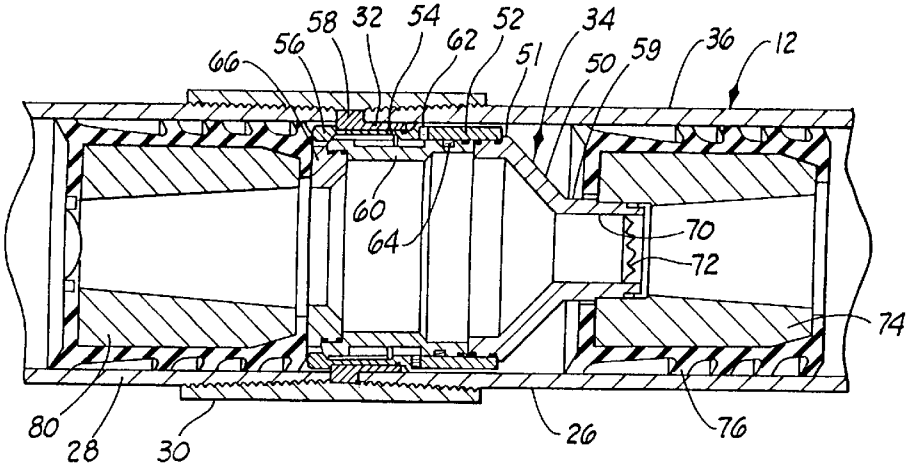
FIG. 7 is an enlarged cross-sectional view similar to FIG. 6 showing the baffle assembly after the bottom cementing plug has landed thereon.
Figure 6:
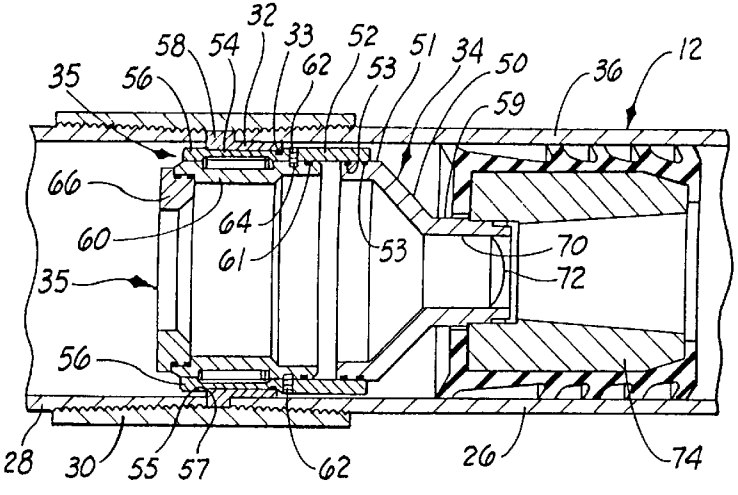
FIG. 6 is an enlarged cross-sectional view of the baffle assembly shown in FIG. 1 releasably connected within a casing string.
Figure 8:
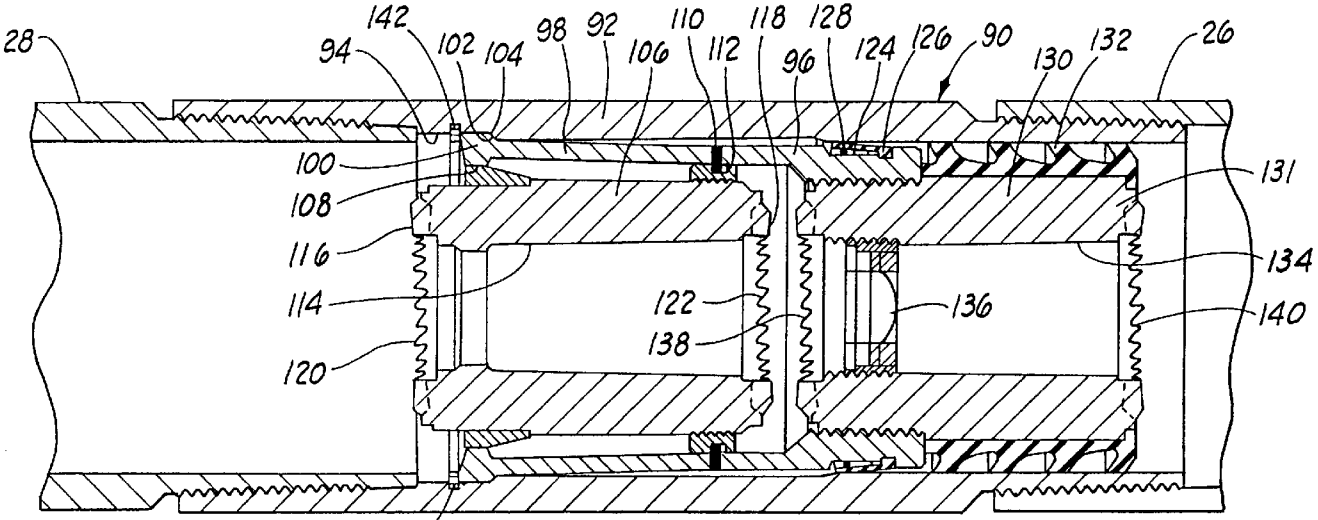
FIG. 8 is an enlarged cross-sectional view similar to FIG. 6 showing the baffle assembly after it has been released and started moving in the casing string.

Referring now to FIGS. 6–8, and particularly to FIG. 6, the selectively openable and releasable closed baffle assembly 34 is illustrated in enlarged detail releasably connected within the second casing string portion 36 of the casing string 12. The closed baffle assembly 34 basically comprises a funnel shaped baffle member 50 which is rigidly connected at its enlarged end 51 to a cylindrical collet 52 that is a part of a releasable connector assembly, generally referred to by the numeral 35. Conventional O-rings 53 disposed between the baffle member 50 and collet 52 provide a fluid tight seal therebetween. The collet 52 includes a plurality of flexible collet fingers 54 having collet heads 56 thereon. The collet 52 is disposed within the previously mentioned cylindrical collet retainer 32 which includes an outwardly extending annular lip portion 58 clamped between the ends of a casing joint 26 and a casing joint 28 connected within the threaded casing collar 30.

A cylindrical collet releasing sleeve 60 is slidably disposed within the collet 52, and at least one shear pin 62 (two are shown) is engaged with the collet 52 and extends into a recess 64 in the releasing sleeve 60. An O-ring 61 provides a seal between the releasing sleeve 60 and the collet 52.

The enlarged collet heads 56 of the collet 52 include outwardly extending portions which form exterior sloping shoulders 55 for contacting a corresponding annular shoulder 57 on the collet retainer 32. An O-ring 33 provides a seal between the collet 52 and the collet retainer 32. The releasing sleeve 60 contacts the collet heads 56 and prevents them from moving inwardly and disengaging from the collet retainer 32. An annular cementing plug landing seat 66 is attached to the releasing sleeve 60.

Attached within the opening 70 formed by the reduced diameter portion 59 of the baffle member 50 is a predetermined fluid pressure operable valve 72. While the valve 72 can take various mechanical forms, it is preferably a rupturable member sealingly attached across the opening 70 in the baffle member 50 which ruptures when a predetermined fluid pressure is exerted thereon.

A hollow wiper plug 74 is connected to the exterior of the reduced diameter portion 59 of the baffle member 50. The wiper plug 74 includes a plurality of resilient wipers 76 which contact the inside surfaces of the casing string 12.

In the operation of the closed baffle assembly 34 (referring to FIGS. 6–8), after the casing string 12 has been placed in the horizontal well bore section 14, drilling fluid is pumped into the casing string at the surface to increase the fluid pressure within the connected casing joints 28 to the predetermined fluid pressure level required to open the valve 72 in the baffle assembly 34. That is, fluid pressure is exerted on the rupturable member 72 by way of the hollow interiors of the releasable connector assembly 35 and the baffle member 50 until the predetermined pressure level required to rupture the rupturable member 72 is equaled or exceeded, and the rupturable member 72 ruptures as illustrated in FIG. 7. After the rupture of the rupturable member 70, the air 25 in the casing string 12 is allowed to percolate through the drilling fluid in the casing to the surface. Thereafter, the drilling fluid is circulated through the casing string 12 and into the annulus 13 between the walls of the well bore 14 and the exterior surface of the casing string 12 (FIG. 1). As mentioned, a less preferable method of removing the air is to circulate drilling fluid through the baffle assembly 34 and through the casing string 12 whereby the air or low density fluid 38 and air 25 are circulated out of the casing string 12. The circulation of drilling fluid for a period of time clears the annulus of debris and conditions it for subsequently receiving a cement slurry.

After the above mentioned circulation has been completed, a bottom cementing plug 80 is displaced by a surface pumped cement slurry through the connected casing joints 28 to the baffle assembly 34 whereupon the plug 80 lands on the seat 66 of the baffle assembly 34 as shown in FIG. 7. The baffle assembly 34 is then released from the collet retainer 32 by increasing the fluid pressure of the cement slurry behind the cement plug 80 to the predetermined fluid pressure required to shear the shear pins 62 and move the releasing sleeve 60 forward. That is, the increased pressure of the cement slurry is exerted by way of the cementing plug 80, the seat 66 and the releasing sleeve 60 on the one or more shear pins 62 retaining the releasing sleeve 60 within the collet 52. As a result and as shown in FIG. 7, the shear pins 62 are sheared which allows the releasing sleeve 60 to move forward a distance sufficient to free the collet heads 56 of the collet 52. Once the collet heads 56 are free to move inwardly, the fluid pressure exerted on the cementing plug 80 and baffle assembly 34 causes the collet heads 56 to move inwardly and slide past the collet retainer 32 as the cementing plug 80 and baffle assembly 34 are moved forwardly as shown in FIG. 8. The baffle assembly 34 and cementing plug 80 are moved through the casing string 12 to the float collar 22 as will be described further below.

Figure 10:
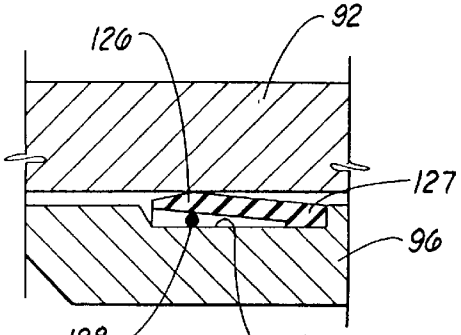
FIG. 10 is an enlarged cross-sectional view of a portion of the baffle assembly of FIG. 9.
Figure 9:
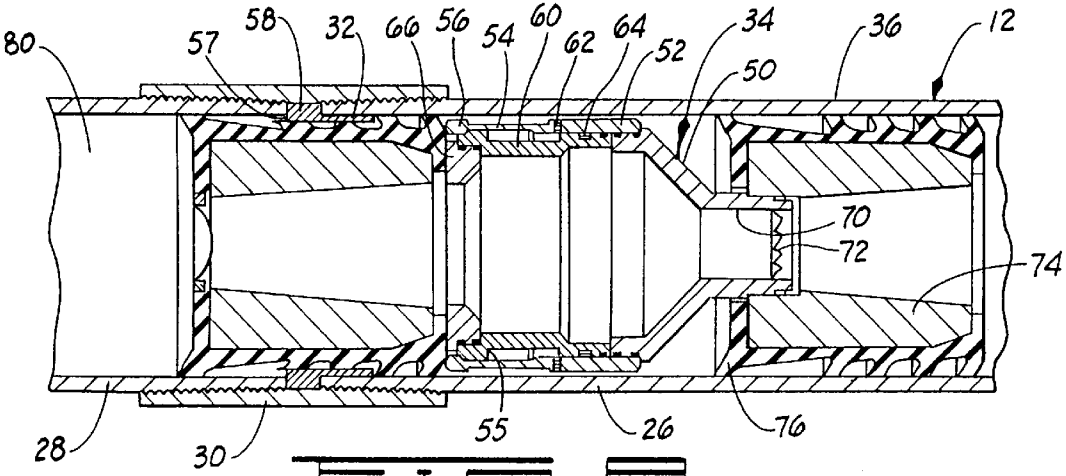
FIG. 9 is a cross-sectional view of an alternate embodiment of a baffle assembly which can be utilized in accordance with the present invention releasably connected within a casing string.

Referring now to FIGS. 9–12, and particularly to FIGS. 9 and 10, an alternate embodiment of the selectively openable and releasable closed baffle assembly of this invention, generally designated by the numeral 90, is illustrated. Instead of the collet retainer 32 clamped between adjacent casing joints as is utilized by the closed baffle assembly 34 described above, the baffle assembly 90 includes a threaded casing sub 92 having an annular collet retaining recess 94 formed in an interior surface thereof. The casing sub 92 and the other components of the closed baffle assembly 90 connected thereto are threadedly connected between a casing joint 26 and a casing joint 28 previously described.

A cylindrical collet 96 having a plurality of flexible collet fingers 98 including head portions 100 is disposed within the casing sub 92. The head portions 100 of the collet 96 include exterior sloping shoulders 102 thereon which engage a sloping complimentary annular shoulder 104 formed in the interior recess 94 in the casing sub 92.

A collet releasing sleeve 106 is slidably disposed within the collet 98 which is positioned to engage a cementing plug displaced into landing contact therewith as will be described below. The releasing sleeve 106 includes an external annular surface 108 which contacts the head portions 100 of the collet 98 and maintains them in engagement with the recess 94 in the casing sub 92. At least one shear pin 110 (two are shown) is engaged with the collet 96 and extends into a recess 112 in the releasing sleeve 106. The releasing sleeve 106 is of a size and shape similar to the internal hollow core of a cementing plug and includes a central opening 114 extending therethrough. The opposite ends 116 and 118 of the releasing sleeve 106 each include an annular serrated surface 120 and 122, respectively, for preventing the rotation of the releasing sleeve in the event that it and similarly formed cementing plugs are drilled out of the casing string.

As best shown in FIG. 10, the collet 96 includes an annular recess 124 disposed in an external surface thereof. An annular lip seal 126 for providing a seal between the collet 96 and an internal surface of the casing sub 92 is disposed in the recess 124. In addition, an O-ring 128 is positioned within the recess 124 between a surface of the recess 124 and the lip seal 126. Alternatively, the O-ring 128 is positioned within a groove within the recess 124, thereby pre-loading the lip seal 126, between a surface of the recess 124 and the lip seal 126. When fluid pressure is applied to the O-ring 128 and the lip seal 126, the O-ring 128 is forced towards the enlarged end portion 127 of the lip seal 126 which in turn forces the lip seal 126 into contact with the interior surface of the casing sub 92 whereby a seal is provided between the casing sub 92 and the collet 96. The lip seal 126 is formed of a hard elastomer material which will withstand high fluid pressures without extruding out of the recess 124. However, because of the hardness of the lip seal 126, a relatively high fluid pressure is required to force it into sealing contact with the casing sub 92 when the O-ring 128 is not present. The O-ring 128 is forced towards the enlarged end portion 127 of the lip seal 126 at relatively low pressures thereby moving the lip seal into sealing contact with the interior surface of the casing sub 92 whereby it provides a seal at such low pressures.

A hollow baffle member 130, which includes a hollow core 131 similar in size and shape to the releasing sleeve 106 and a plurality of wipers 132 for contacting the inside surfaces of the casing string 12, is rigidly attached to the collet 96. Sealingly disposed within the opening 134 extending through the baffle member 130 is a predetermined fluid pressure operable valve 136. The valve 136 is preferably a rupturable valve member which ruptures when the predetermined fluid pressure is exerted thereon. Like the releasing sleeve 106, the baffle member 130 includes opposite annular serrated ends 138 and 140 for engaging the serrated surface 122 of the releasing sleeve 106 and a complimentary serrated surface on a float collar or float shoe when landed thereon. At least one lock ring disposed in a groove, both designated by the numeral 142, are utilized to maintain the collet 96 and other parts of the assembly attached thereto within the casing sub 92.

Figure 11:
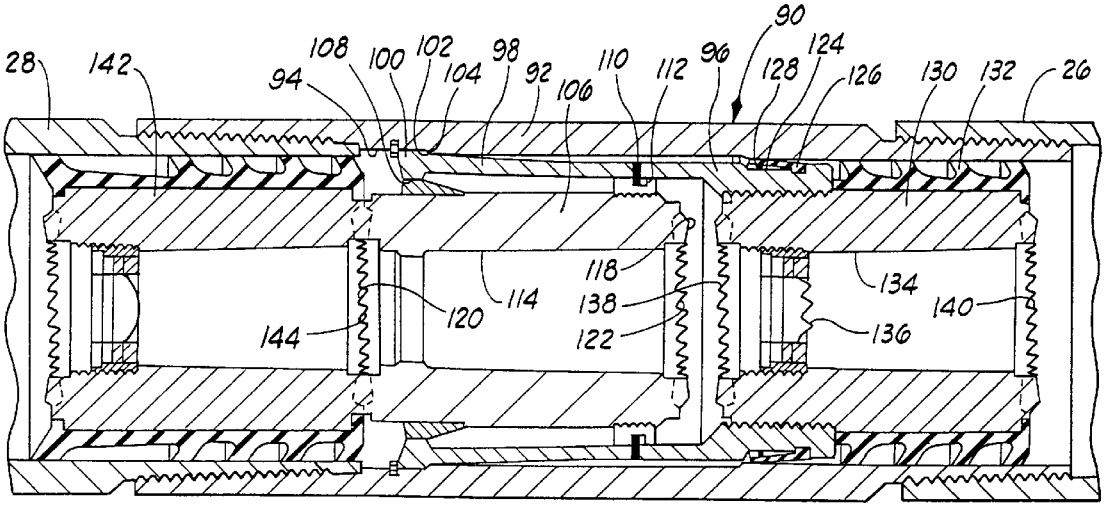
FIG. 11 is a cross-sectional view similar to FIG. 9 showing the baffle assembly after a bottom cementing plug has landed thereon.
Figure 12:
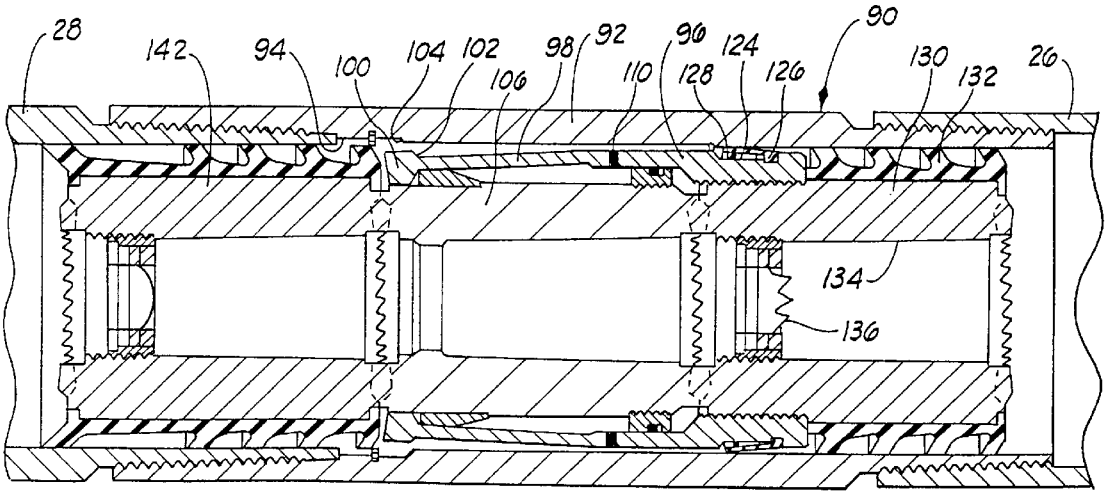
FIG. 12 is a cross-sectional view similar to FIG. 9 showing the baffle assembly after it has been released and started moving in the casing string.

The operation of the closed baffle assembly 90 is similar to the operation of the closed baffle assembly 34 described above. Referring to FIGS. 11 and 12, after the casing string within which the closed baffle assembly 90 is attached has been placed in a horizontal well bore section, drilling fluid is pumped into the casing string from the surface to increase the fluid pressure exerted on the closed baffle assembly 90 to cause it to open. That is, the increasing fluid pressure is exerted on the rupturable valve member 136 by way of the hollow interiors of the releasing sleeve 106 and baffle member 130 until the predetermined pressure level required to rupture the rupturable member 136 is reached and the rupturable member 136 ruptures as illustrated in FIGS. 11 and 12. After the opening of the rupturable valve member 136, the air in the casing string is allowed to percolate out of the casing string. Thereafter, the drilling fluid is circulated through the drill string and annulus as previously described in connection with the closed baffle assembly 34.

After the circulation of drilling fluid has been completed, a bottom cementing plug 142 which includes a serrated surface 144 that is complimentary to the serrated surface 120 of the releasing sleeve 106 is displaced by a surface pumped cement slurry through the connected casing joints 28 into landing contact with the releasing sleeve 106 as shown in FIG. 11. The portion of the closed baffle assembly 90 within the casing sub 92 is then released from the casing sub by increasing the pressure of the cement slurry on the cement plug 142 to the predetermined fluid pressure required. That is, the pressure of the cement slurry is increased to a level equal to or greater than the predetermined fluid pressure which is exerted on the shear pins 110 retaining the releasing sleeve 106 within the collet 96 by way of the cementing plug 142 and releasing sleeve 106. As a result and as shown in FIG. 12, the shear pins 110 are sheared which allows the releasing sleeve 106 to move forwardly a distance sufficient to release the collet heads 100 from the recess 94 in the casing sub 92. Once the collet heads 100 are released, the fluid pressure exerted on the cementing plug 142 and the releasing sleeve 106 causes the cementing plug 142, the releasing sleeve 106 and the other internal baffle assembly parts to move toward the leading end of the casing string 12 as shown in FIG. 12.

Figure 2:
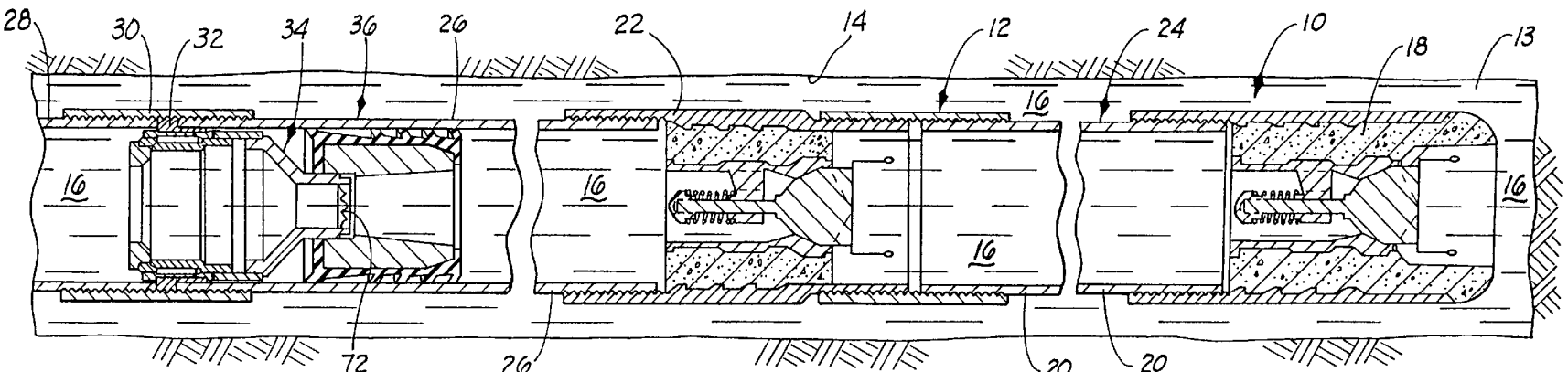
FIG. 2 is a cross-sectional view similar to FIG. 1 showing the casing string apparatus after a baffle assembly has been opened and drilling fluid circulated through the drill string into the annulus.
Figure 3:
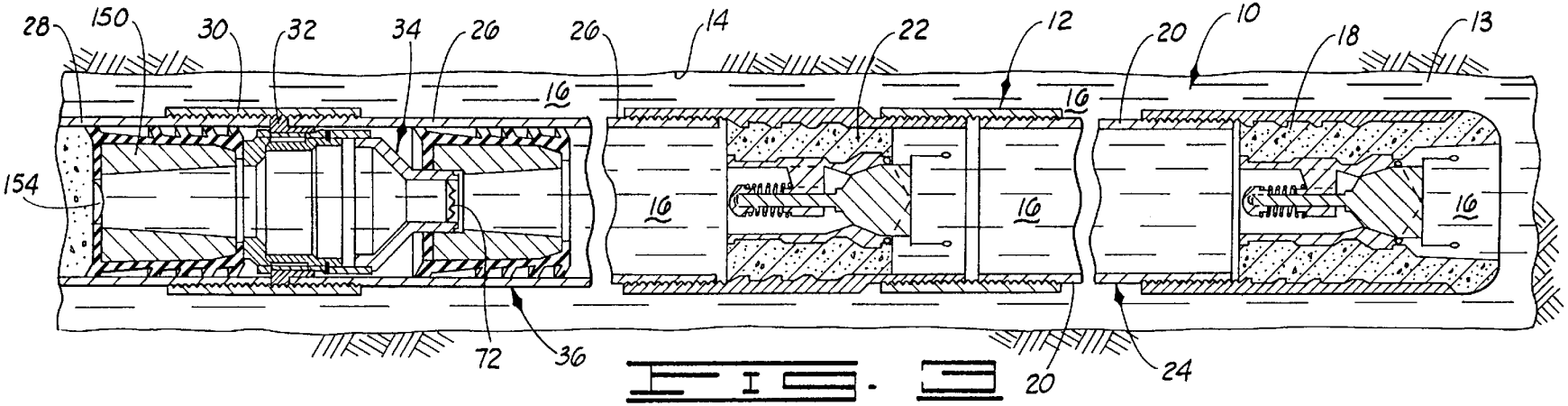
FIG. 3 is a cross-sectional view similar to FIG. 1 showing the casing string apparatus after a bottom cement plug displaced by a cement slurry has landed on the baffle assembly.

The improved methods of the present invention for placing casing in a horizontal well bore section of a horizontal well containing drilling fluid basically comprise the following steps which are described with reference to FIGS. 1–5:

(1) connecting the float shoe 18 to the lower end of a first joint of casing 20 and running the first joint 20 into the well without filling it with drilling fluid, (2) connecting additional casing joints 20 to the first joint 20 as the additional joints 20 are run into the well without filling the additional joints with drilling fluid thereby forming a string of casing containing only air 25, (3) connecting the float collar 22 to the connected casing joints 20 to thereby trap the air 25 in the connected casing joints 20, (4) connecting additional casing joints 26 to the float collar 22 without filling the connected joints 26 or filling the connected joints 26 with a low density fluid other than air as the joints 26 are run into the well, (5) connecting the closed baffle assembly 34 (or the closed baffle assembly 90) within the interior of the connected casing joints 26 thereby trapping the air or other low density fluid 38 within the connected casing joints 26 whereby the portion 36 of the casing string 12 filled with air or low density fluid 38 and the portion 24 filled with air 25 are buoyed up by drilling fluid 16 in the horizontal well bore section 14 thereby reducing the drag on those portions during their placement in the horizontal well bore section 14, (6) connecting additional casing joints 28 to the string of casing 12 and filling the additional joints with drilling fluid 16 as they are run into the well until the buoyed up portions 24 and 36 of the string of casing 12 are placed in a desired location in the horizontal well bore section 14, and (7) opening the closed baffle assembly 34 by exerting thereon the predetermined fluid pressure required to rupture the rupturable valve member 72 thereof as shown in FIG. 2.

Figure 4:
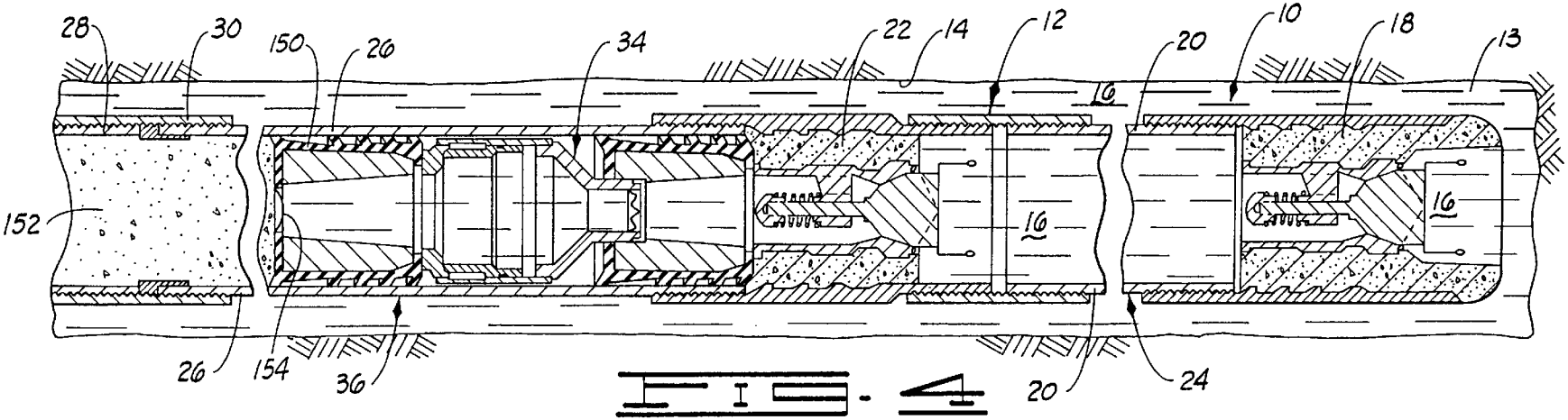
FIG. 4 is a cross-sectional view similar to FIG. 1 showing the casing string apparatus after the baffle assembly has been released and it and the bottom cementing plug have landed on a float collar.
Figure 5:
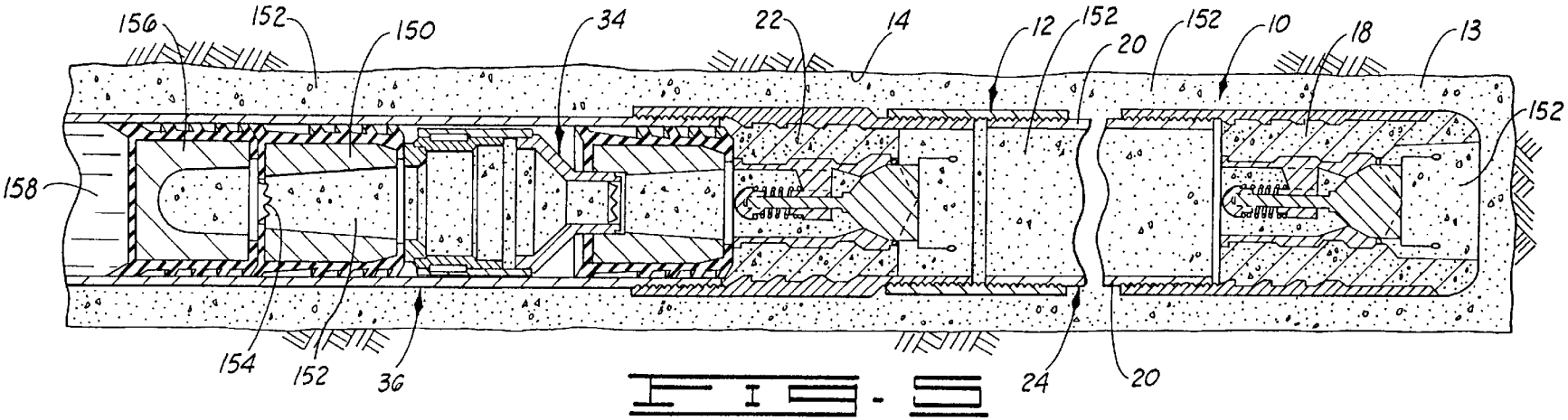
FIG. 5 is a cross-sectional view similar to FIG. 1 showing the casing string apparatus after the cement slurry has flowed through the casing string into the annulus and a top cementing plug has landed on the bottom cementing plug.

After the string of casing 12 has been placed and the predetermined fluid pressure operable valve 72 of the closed baffle assembly 34 has been opened, the following additional steps are performed to cement the casing string 12 in the horizontal well bore section 14, (8) allowing the air 25 to percolate out of the casing string 12 or circulating the air out and flowing drilling fluid through the casing string 12 into the annulus 13 to condition the annulus 13 for receiving a cement slurry as shown in FIG. 2, (9) flowing a cement slurry 152 behind a selectively openable bottom cementing plug 150 into the casing string 12 whereby the bottom plug 150 is displaced into landing contact with the baffle assembly 34,

(10) releasing the baffle assembly 34 from its connection with the string of casing 12 by exerting the predetermined fluid pressure by way of the bottom plug 150 on the baffle assembly 34 required to release the baffle assembly 34,

(11) continuing the flow of the cement slurry 152 whereby the bottom plug 150 and the baffle assembly 34 are displaced through the string of casing 12 and land on the float collar 22 as shown in FIG. 4,

(12) opening the bottom plug 150 by exerting the predetermined fluid pressure on the bottom plug 150 required to rupture the rupturable valve member 154 attached thereto as shown in FIG. 5,

(13) flowing a displacement fluid 158 behind a top cementing plug 156 into the casing string 12 whereby the top plug 156 is displaced into landing contact with the bottom plug 150 and the cement slurry 152 is displaced into the annulus 13 as illustrated in FIG. 5, and

(14) allowing the cement slurry 152 to set into a hard impermeable mass in the annulus 13.

As will be understood by those skilled in the art, after the cement slurry has set in the annulus, if it is necessary or desirable, the cementing plugs 150 and 156, the baffle assembly 34, the float collar 22, set cement in the connected casing joints 20 and the float shoe 18 can all be drilled out of the casing string 12.

In order to further illustrate the methods and apparatus of this invention, the following example is given. In the example, FIG. 1 of the drawings and the reference numerals thereon are referred to.

EXAMPLE

An extended reach well bore is drilled into a hydrocarbon producing formation at a depth of about 2,000 feet having a substantially vertical well bore section extending into the formation and a substantially horizontal well bore section extending within the formation for a distance of about 4,000 feet from the vertical well bore section. After the drilling is completed, the horizontal and vertical well bore sections both contain drilling fluid.

A conventional float shoe 18 is connected to the lower end of a first joint 20 of 7 inch casing and the first joint is run in the well followed by 1 or more (generally 1–3) additional 7 inch casing joints none of which are filled with drilling or other fluid. A float collar 22 is connected to the resulting string of casing which traps the air therein thereby forming a 40–120 foot long string of casing between the float shoe 18 and the float collar 22 containing only air.

80–100 additional 7 inch casing joints 26 are connected to the float collar 22 and to each other which are also not filled with drilling or other fluid. A selectively openable and releasable closed baffle assembly 34 is connected within the interior of the portion of the casing string formed by the joints 26 whereby air is trapped therein forming a 3,000–4,000 foot portion of the casing string between the float collar 22 and the baffle assembly 34 containing air. The baffle assembly 34 includes a predetermined fluid pressure rupturable valve member 72 attached thereto and is connected within the interior of the casing string by a predetermined fluid pressure releasable collet connector 35.

Additional casing joints 28 are connected to the string of casing above the closed baffle assembly 34 and to each other which are filled with drilling fluid as they are run into the well bore. The drilling fluid contained in the well bore and placed within the casing string above the closed baffle assembly is a water based drilling fluid containing hydrated clay, hydrated polymer, weighting material and other additives whereby it has a density of from about 9 to about 20 pounds per gallon.

The leading portion of the drill string containing air and the following portion containing air are buoyed up by the drilling fluid contained in the horizontal well bore section as the casing string is inserted therein. The buoying up of the casing string substantially reduces the drag forces exerted on the casing string as it is slid through the horizontal well bore section. Additional casing joints 28 are added to the casing string at the surface until the buoyed up portions of the casing string are placed in a desired location in the horizontal well bore section.

After placement of the casing string, the closed baffle assembly 34 is opened by exerting the predetermined fluid pressure required to rupture the valve member 72 attached thereto. The air in the casing string is allowed to percolate through the casing to the surface, and drilling fluid is then circulated through the casing string and through the annulus whereby the annulus is conditioned for receiving a cement slurry.

A cement slurry is next flowed through the casing string behind a selectively openable bottom cementing plug whereby the bottom plug is displaced into landing contact with the baffle assembly. The baffle assembly is released from its connection with the interior of the string of casing by the exertion of a predetermined fluid pressure on the bottom plug which in turn exerts a force on the releasable fluid pressure operable collet connector 35 so that the baffle assembly is released.

The flow of the cement slurry through the casing string is continued whereby the bottom plug and baffle assembly are displaced through the casing string into landing contact on the float collar. The closed bottom plug is then opened by exerting a predetermined fluid pressure on a rupturable valve member attached thereto so that the cement slurry is flowed through the casing string into the annulus. A displacement fluid behind a top cementing plug is next flowed into the casing string whereby the top plug is displaced into landing contact with the bottom plug and the cement slurry is displaced into the annulus. Thereafter the cement slurry is allowed to set into a hard impermeable mass in the annulus.

Thus, the present invention is well adapted to carry out the objects and attain the benefits and advantages mentioned as well as those which are inherent therein. While numerous changes to the apparatus and methods can be made by those skilled in the art, such changes are encompassed within the spirit of this invention as defined by the appended claims.

What is claimed is:

1. An improved method of placing casing in a horizontal well bore section of a horizontal well containing drilling fluid comprising the steps of:

(a) connecting a float shoe to the lower end of a first joint of casing and running said first joint into said well;

(b) connecting additional joints of casing to said first joint as said joints are run into said well without filling said joints with drilling or other fluid thereby forming a string of casing containing only air;

(c) connecting a float collar to said string of casing;

(d) connecting additional joints of casing to said string of casing above said float collar without filling said joints with drilling or other fluid whereby said joints contain only air or filling said joints with a low density fluid as said joints are run into said well;

(e) connecting a selectively openable and releasable closed baffle assembly within the interior of said string of casing thereby trapping said air or low density fluid within the portion of said string of casing between said float collar and said baffle assembly whereby that portion of said string of casing and the portion filled with air between said float collar and said float shoe are buoyed up by drilling fluid in said horizontal well bore section of said well thereby reducing the drag on said portions during their placement in said horizontal well bore section, said baffle assembly being closed by a predetermined fluid pressure operable valve member attached thereto and being connected within the interior of said string of casing by a releasable fluid pressure operable connector attached thereto;

(f) connecting additional joints of casing to said string of casing above said closed baffle assembly and filling said joints with drilling fluid as said joints are run into said well until said buoyed up portions of said string of casing are placed in a desired location in said horizontal well bore section of said well; and (g) opening said closed baffle assembly by exerting said predetermined fluid pressure on said valve member attached thereto whereby fluids can be flowed through said string of casing into the annulus between said string of casing and said well.

2. The method of claim 1 wherein said predetermined fluid pressure operable valve member attached to said baffle assembly is comprised of a rupturable member sealingly attached over an opening in said baffle assembly which ruptures when said predetermined fluid pressure is exerted thereon.

3. The method of claim 1 wherein said drilling fluid is a liquid having a density in the range of from about 9 to about 20 pounds per gallon.

4. The method of claim 1 wherein said drilling fluid has a density in the range of from about 12 to about 15.5 pounds per gallon.

5. The method of claim 1 wherein said low density fluid is selected from the group consisting of water, aqueous emulsions, aqueous foams and hydrocarbon liquids.

6. The method of claim 1 which further comprises the steps of:

flowing one or more fluids through said string of casing and said annulus whereby said annulus is conditioned for receiving a cement slurry;

flowing a cement slurry through said string of casing and into said annulus; and allowing said cement slurry to set into a hard impermeable mass in said annulus.

7. An improved method of placing and cementing casing in a horizontal well bore section of a horizontal well containing drilling fluid comprising the steps of:

(a) connecting a float shoe to the lower end of a first joint of casing and running said first joint into said well;

(b) connecting additional joints of casing to said first joint as said joints are run into said well without filling said joints with drilling or other fluid thereby forming a string of casing containing only air;

(c) connecting a float collar to said string of casing;

(d) connecting additional joints of casing to said string of casing above said float collar without filling said joints with drilling or other fluid whereby said joints contain only air or filling said joints with a low density fluid as said joints are run into said well;

(e) connecting a selectively openable and releasable closed baffle assembly within the interior of said string of casing thereby trapping said air or low density fluid within the portion of said string of casing between said float collar and said baffle assembly whereby that portion of said string of casing and the portion filled with air between said float collar and said float shoe are buoyed up by drilling fluid in said horizontal well bore section of said well thereby reducing the drag on said portions during their placement in said horizontal well bore section, said baffle assembly being closed by a predetermined fluid pressure operable valve attached thereto and being connected within the interior of said string of casing by a releasable fluid pressure operable connector attached thereto;

(f) connecting additional joints of casing to said string of casing above said closed baffle assembly and filling said joints with drilling fluid as said joints are run into said well until said buoyed up portions of said string of casing are placed in a desired location in said horizontal well bore section of said well; and (g) opening said closed baffle assembly by exerting said predetermined fluid pressure on said valve member attached thereto;

(h) allowing said air in said string of casing to percolate through said casing to the surface;

(i) flowing one or more fluids through said string of casing and said annulus whereby said annulus is conditioned for receiving a cement slurry;

(j) flowing a cement slurry behind a selectively openable bottom cementing plug into said string of casing whereby said bottom plug is displaced into landing contact with said closed baffle assembly, said bottom plug being closed by a predetermined fluid pressure operable valve member attached thereto;

(k) releasing said baffle assembly from its connection with the interior of said string of casing by exerting said predetermined fluid pressure by way of said bottom plug on said connector attached to said baffle assembly;

(l) continuing the flow of said cement slurry through said string of casing whereby said bottom plug and said baffle assembly are displaced through said string of casing and land on said float collar;

(m) opening said closed bottom plug by exerting said predetermined fluid pressure on said valve member attached thereto whereby said cement slurry can be flowed through said string of casing into said annulus;

(n) flowing a displacement fluid behind a top cementing plug into said string of casing whereby said top plug is displaced into landing contact with said bottom plug and said cement slurry is displaced into said annulus; and (o) allowing said cement slurry to set into a hard impermeable mass in said annulus.

8. The method of claim 7 wherein said predetermined fluid pressure operable valve attached to said baffle assembly is comprised of a rupturable member sealingly attached over an opening in said baffle assembly which ruptures when said predetermined fluid pressure is exerted thereon.

9. The method of claim 8 wherein said predetermined fluid pressure operable valve attached to said bottom cementing plug is comprised of a rupturable member sealingly attached over an opening in said bottom plug which ruptures when said predetermined fluid pressure is exerted thereon.

10. The method of claim 7 wherein said drilling fluid has a density in the range of from about 9 to about 20 pounds per gallon.

11. The method of claim 7 wherein said drilling fluid has a density in the range of from about 12 to about 15.5 pounds per gallon.

12. The method of claim 11 wherein said low density fluid is selected from the group consisting of water, aqueous emulsions, aqueous foams and hydrocarbon liquids.

13. An improved apparatus for facilitating the placement of a casing string in a horizontal well bore section of a horizontal well containing drilling fluid comprising:

a float shoe attached to the end of said casing string which first enters said horizontal well bore section during placement;

a float collar connected in said casing string for trapping air in a first portion of said casing string thereby causing said first portion to be buoyed up during placement in said horizontal well bore section by said drilling fluid therein whereby drag on said first portion is reduced;

a selectively openable and releasable closed baffle means connected in said casing string for trapping air or a low density fluid in a second portion of said casing string thereby causing said second portion to be buoyed up during placement in said horizontal well bore section by said drilling fluid therein whereby drag on said second portion is reduced, said closed baffle means including a predetermined fluid pressure operable valve attached thereto and being connected in said string of casing by a predetermined fluid pressure operable releasable connector assembly; and wherein said predetermined fluid pressure operable valve attached to said closed baffle means is comprised of a rupturable member sealingly attached over an opening in said baffle means which ruptures when said predetermined fluid pressure is exerted thereon.

14. The apparatus of claim 13 wherein said predetermined fluid pressure operable releasable connector assembly attached to said baffle assembly comprises:

a collet retainer clamped between adjacent joints of said casing string;

a collet retained within said collet retainer;

a collet releasing sleeve slidably disposed within said collet positioned to sealingly engage a cementing plug displaced into landing contact therewith;

at least one shear pin engaged with said collet and extending into a recess in said collet releasing sleeve; and a cementing plug adapted to land on said releasing sleeve seat and transmit fluid pressure exerted on it to said releasing sleeve and to said shear pin.

15. The apparatus of claim 14 wherein said cementing plug includes a predetermined fluid pressure operable valve attached thereto for allowing the passage of a cement slurry therethrough.

16. The apparatus of claim 15 wherein said predetermined fluid pressure operable valve attached to said cementing plug is comprised of a rupturable member sealingly attached over an opening in said cementing plug which ruptures when said predetermined fluid pressure is exerted thereon.

17. The apparatus of claim 14 wherein said closed baffle means further comprises slidable wiper means attached thereto.

18. The apparatus of claim 14 wherein said closed baffle means further comprises a seat for sealingly receiving said cementing plug attached to said releasing sleeve.

19. The apparatus of claim 13 wherein said predetermined fluid pressure operable releasable connector assembly attached to said baffle assembly comprises:

a threaded casing sub having an annular collet retaining recess formed in an interior surface thereof threadedly connected to said casing string;

a cylindrical collet disposed within said sub and retained therein by said retaining recess;

a collet releasing sleeve slidably disposed within said collet positioned to engage a cementing plug displaced into landing contact therewith;

at least one shear pin engaged with said collet and extending into a recess in said collet releasing sleeve; and a cementing plug adapted to land on said releasing sleeve and transmit fluid pressure exerted on it to said releasing sleeve and to said shear pin.

20. The apparatus of claim 19 wherein said cementing plug includes a predetermined fluid pressure operable valve attached thereto for allowing the passage of a cement slurry therethrough.

21. The apparatus of claim 20 wherein said predetermined fluid pressure operable valve attached to said cementing plug is comprised of a rupturable member sealingly attached over an opening in said cementing plug which ruptures when said predetermined fluid pressure is exerted thereon.

22. The apparatus of claim 19 wherein said closed baffle means further comprises slidable wiper means attached thereto.

23. The apparatus of claim 19 wherein said closed baffle means further comprises a seat for sealingly receiving said cementing plug attached to said releasing sleeve.

24. The apparatus of claim 19 wherein said closed baffle assembly further comprises:

said collet including an annular recess disposed in an exterior surface thereof;

an annular lip seal disposed in said recess for providing a seal between said collet and the interior surface of said casing sub; and an O-ring disposed in said recess between said collet and said lip seal for facilitating the movement of said lip seal into sealing contact with said interior surface of said casing sub when fluid pressure is exerted thereon.

25. A selectively operable and releasable closed baffle assembly for attachment within a pipe string comprising:

an internal collet retainer adapted to be connected to said pipe string;

a cylindrical collet disposed within and retained by said collet retainer having an annular recess formed in an exterior surface thereof;

a collet releasing sleeve slidably disposed within said collet positioned to engage a cementing plug displaced into landing contact therewith;

at least one shear pin engaged with said collet and extending into a recess in said collet releasing sleeve, said shear pin shearing when a predetermined fluid pressure is exerted on said collet releasing sleeve by a cementing plug landed thereon;

a baffle member sealingly connected to said collet having an opening therethrough; and a predetermined fluid pressure operable valve means sealingly attached to said opening in said baffle member.

26. The assembly of claim 25 wherein said collet retainer is a cylindrical member having an annular lip portion extending outwardly therefrom for clamping engagement between the ends of adjacent pipe joints.

27. The assembly of claim 25 wherein said closed baffle assembly further comprises slidable wiper means attached thereto.

28. The assembly of claim 25 wherein said closed baffle assembly further comprises a seat for sealingly receiving said cementing plug attached to said releasing sleeve.

29. A selectively operable and releasable closed baffle assembly for attachment within a pipe string comprising:

a cylindrical collet disposed within an internal recess of a casing sub;

an annular lip seal disposed in a recess on said collet for providing a seal between said collet and an interior surface of said casing sub;

an O-ring disposed in an external recess of said collet for facilitating the movement of said lip seal into sealing contact with the interior surface of said casing sub;

a collet releasing sleeve slidably disposed within said collet positioned to engage a cementing plug displaced into landing contact therewith;

at least one shear pin engaged with said collet for shearing when a predetermined fluid pressure is exerted on said collet releasing sleeve by a cementing plug landed thereon;

a baffle member sealingly connected to said collet having an opening therethrough; and a predetermined fluid pressure operable valve means sealingly attached to said opening in said baffle member.

30. The assembly of claim 29 wherein said casing sub is threadedly connected in said pipe string.

31. The assembly of claim 29 wherein said closed baffle assembly further comprises slidable wiper means attached thereto.

32. The assembly of claim 29 wherein said closed baffle assembly further comprises a seat for sealingly receiving said cementing plug attached to said releasing sleeve.

* * * * *